US005732784A

United States Patent [19]

Nelson

[11] Patent Number: 5,732,784

[45] Date of Patent: Mar. 31, 1998

[54] CUTTING MEANS FOR DRAG DRILL BITS

[76] Inventor: Jack R. Nelson, 927 Peachwood Bend, Houston, Tex. 77077

[21] Appl. No.: 684,875

[22] Filed: Jul. 25, 1996

[51] Int. Cl.[6] ..... E21B 10/26

[52] U.S. Cl. ..... 175/385; 175/393; 175/420.2

[58] Field of Search ..... 175/385, 389, 175/393, 401, 420.1, 420.2, 428, 429, 431, 434

[56] References Cited

U.S. PATENT DOCUMENTS

| | | | |
|---|---|---|---|
| 3,773,122 | 11/1973 | Chromy | 175/420.1 X |
| 3,960,223 | 6/1976 | Kleine | 175/420.1 X |
| 4,275,796 | 6/1981 | Kleine | 175/420.1 X |
| 4,294,319 | 10/1981 | Geerogen | 175/420.1 X |
| 4,540,056 | 9/1985 | Ohanlon | 175/39.3 |
| 4,729,441 | 3/1988 | Peetz et al. | 175/420.1 X |
| 4,765,419 | 8/1988 | Scholz et al. | 175/420.1 X |
| 4,819,748 | 4/1989 | Truscott | 175/393 X |
| 5,027,912 | 7/1991 | Juergens | 175/429 X |

*Primary Examiner*—Roger J. Schoeppel
*Attorney, Agent, or Firm*—Bush, Riddle & Jackson

[57] ABSTRACT

A drag rotary bit (10) has a bit body (12) with a center cutter element (34) for projecting from the bottom (22) of the bit body (12) at the axial center of the bit body (12). The center cutting element (34) has a pair of cutters (42) with cutting faces (46) thereon in opposed relation to each other. A pair of opposed relatively long blades (54) are mounted on the bottom (22) of the bit body (12) and extend across the entire bottom (22) of the bit body (12) to the center cutter (34) to divide the bottom (22) into two separate areas. A single nozzle (26) having a large diameter discharge port (28) is provided for each of the separate areas for cleaning the bottom of the hole and washing of the blades.

15 Claims, 2 Drawing Sheets

CUTTING MEANS FOR DRAG DRILL BITS

BACKGROUND OF THE INVENTION

1. Field of the Invention

This invention relates to drag drill bits for oil and gas wells, and more particularly to a drag drill bit having cutting elements positioned thereon for maintaining the center of the drag bit in axial alignment with the center of the well or hole throughout the drilling operation.

2. Description of the Prior Art

It is highly desirable that drill bits maintain a drilling axis along the center of the drill hole or well. If a drill bit deviates or deflects from the true center of the drill hole, a whirling occurs which results in the drilling of a hole having a diameter lesser than required or desired. Antiwhirl features known to the drilling industry today include such features as a flat bit profile, a slide gauge bit, a low friction gauge or offset bit with force imbalances. All these features have generally been ineffective in controlling bit whirling. Since bit whirling reduces penetration rates, causes severe wear of bit gauges which reduces the hole diameter, a need exists for bit arrangements that will prevent the bits from whirling so that the hole is reamed to the programmed diameter.

U.S. Pat. No. 4,872,520 dated Oct. 10, 1989 shows a drag drill bit in which the body has a flat bottom. A plurality of separate cutting elements on the bottom of the drill bit are in the same horizontal plane and each cutting element includes a sharp chisel edged apex to provide a chisel surface for acting on the earth formation.

SUMMARY OF THE INVENTION

The present invention is directed to a drag drill bit that is effective to maintain the center of the drill bit in axial alignment with the center of the well or hole throughout the drilling operation. The body of the drag drill bit has a bottom with a plurality of cutting elements thereon including a center cutting element positioned centrally of the axis of rotation in axial alignment with the longitudinal axis of the drag drill bit. The center cutting element comprises a generally cylindrical center stud or post having a pair of lower cutting forces positioned generally at one hundred eighty (180) degrees to each other and facing in the same direction of rotation with each face extending in a generally lateral direction from the center of the cylindrical cutting element. The arrangement of such a cutting element at the center of bit which projects downwardly from the bit a distance greater than the projecting distance of the remaining cutting elements tends to maintain the bit at the geometric center of the well during the drilling operation. Thus, a balanced cutting action is achieved with a high penetration rate. Also, any wobbling of the bit on the face of the formation resulting from the weight on the bit will be minimized.

The center stud or post is of a generally cylindrical shape having an upper end for securement to the bit body and a lower projecting end having a pair of pockets ground therein forming a pair of base surfaces on which a cutting element is secured, such as by brazing or welding. The cutting element is preferably a polycrystalline diamond cutting element of a semi-circular shape such as a polycrystalline diamond cutting element similar to the Stratapax type manufactured by the General Electric Company and described in Daniels, et al U.S. Pat. No. 4,156,329 dated May 29, 1979 and Knemeyer U.S. Pat. No. 4,225,322 dated Sep. 30, 1980. The Stratapax type cutting element has an outer thin diamond layer secured to a hard carbide metal substrate or base.

The outer diamond layer defines a planar cutting face and cutting edge secured to the hard metal base which has a rear support face secured, such as by brazing to the stud. Such Stratapax type cutting elements are in wide commercial usage. The term "diamond", "polycrystalline diamond", "polycrystalline diamond compact" or "PDC" cutting element used in the specification and claims herein shall be interpreted as including all diamond or diamond-like cutting elements having a hardness generally similar to the hardness of a natural diamond. The use of diamond in cutting elements is especially important in drag-type bits in order to increase their life. The polycrystalline diamond material typically is provided in the form of a relatively thin diamond layer of around 0.020 inch in thickness, for example, on one face of a disc formed of tungsten carbide. The disc may be formed into two semicircular halves for mounting on the base surfaces of the stud. It may be desirable in some instances to utilize natural diamond instead of the PDC (man-made) diamond inserts or cutting elements. In this event, for example, diamond chips of a size of about two to six chips per carat are flush set on the base mounting surface of the stud. A disc is normally secured, such as by brazing, to the body of a stud to form an insert which fits within a bore or recess in the body of the drag type drill bit.

Drilling fluids discharged from nozzles aid in cooling the cutting elements, as well as aiding in removing the chips or rock cuttings in front of the cutting elements when the jet or spray is directed in advance of the cutting elements. The discharge nozzles may be positioned at various locations and provided in a variety of different embodiments.

The discharge nozzles utilized in the present invention comprise a pair of nozzles positioned adjacent the center stud at 180 degrees to each other. A large nozzle size, such as a nozzle having a diameter of 18/32 inch, is adequate when utilizing two nozzles to provide the desired turbulence for maximum hydraulic effectiveness. Additional cutting elements are mounted on a plurality of arcuately spaced blades extending along the bottom of the bits. Two opposed blades extend to the center cutting element to divide the bit bottom into two areas, one for each of the nozzles.

It is an object of this invention to provide a drag rotary drill bit having a center stud for a cutting surface positioned at the center of the drill bit for maintaining the drill bit at the true center of the hole during the drilling operation.

It is a further object of the invention to provide such a center stud for a drag drill bit which includes a pair of cutting faces mounted on the stud at one hundred and eighty degrees (180) to each other and facing in the same direction of rotation for engaging the earth formation at the bottom of the hole.

Another object of the invention is to provide such a drag bit having a pair of opposed blades extending along the entire bottom of the bit to the center stud and terminating at the center stud to separate the drill bit into two opposed bottom areas with a single fluid discharge nozzle for each of the bottom areas thereby to achieve maximum hydraulic effectiveness.

Other objects, features, and advantages of the invention will become more apparent after referring to the following specification and drawings.

DESCRIPTION OF THE INVENTION

Figure 2:
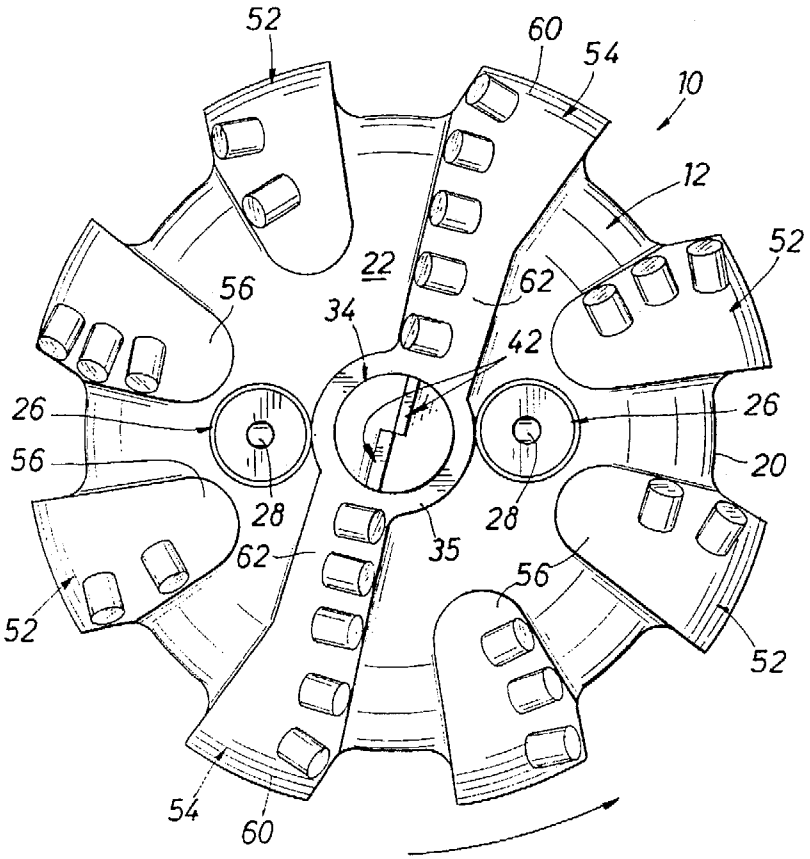
FIG. 2 is a bottom plan of the drill bit of FIG. 1 showing the blades with cutting elements thereon along the bottom of the bit body and a pair of cutting faces on the center cutter element adjacent a pair of opposed blades which extend to the center cutting element.
Figure 1:
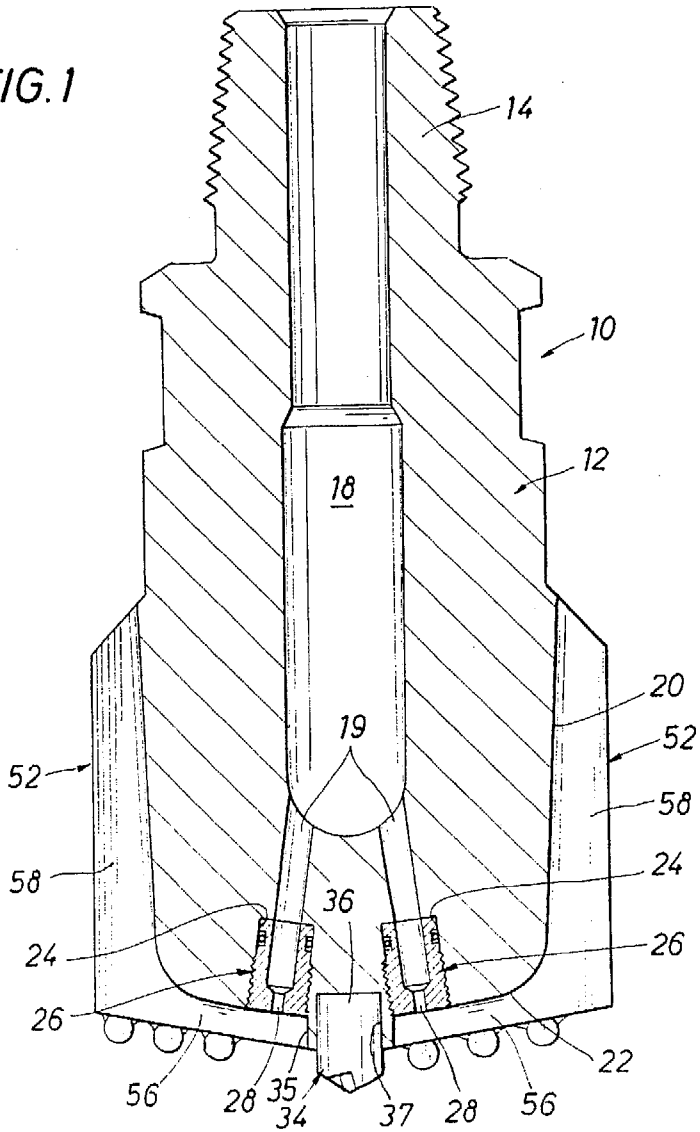
FIG. 1 is a longitudinal sectional view of the drag drill bit forming the present invention and showing a center cutter element at the axial center of the bit body with a pair of opposed fluid discharge nozzles adjacent the center cutter.
Figure 3:
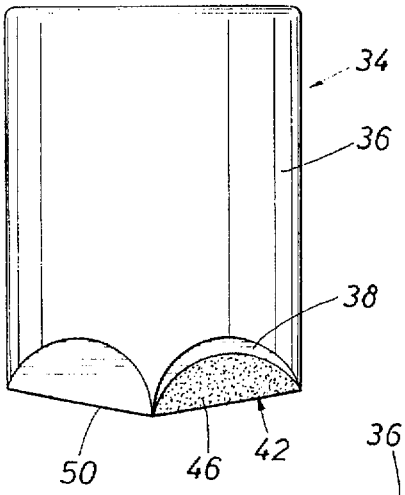
FIG. 3 is a side elevational view of the center cutting element removed from the drill bit and including a cylindrical stud having a pair of opposed cutting faces thereon extending from the center of the stud.

Referring to the drawings for a better understanding of this invention and more particularly to FIGS. 1 and 2, a drag type rotary drill bit is shown generally at 10 having a generally cylindrical bit body 12 with an externally threaded pin 14 at its upper end. Pin 14 is adapted for threading within the lower end of a drill string (not shown) suspended from a drill rig at the surface for rotating drill bit 10. Drill bit body 12 has a longitudinally extending main flow or fluid passage 18 which is adapted to receive drilling fluid or mud from the drill rig for the drilling operation. Lower branch flow passages 19 extend from main flow passage 18. Bit body 12 has an outer peripheral surface 20 and a lower face or bottom surface 22 forming a crown. Mounted within an enlarged diameter end portion 24 of each branch flow passage 18 is an externally threaded fluid discharge nozzle indicated generally at 26. Nozzle 26 has an outer fluid discharge port 28 arranged at an angle about ten (10) degrees with respect to the longitudinal axis of bit body 20. A stream of drilling fluid is directed against the formation from the drill string and tends to remove cuttings or the like from the formation prior to the cutting action. Discharge port 28 is formed of a predetermined maximum size between about 15/32 inch and 18/32 inch to provide increased turbulence for maximum effectiveness of the hydraulic action against the formation. Preferably, only two nozzles 26 are utilized with a maximum size port for each nozzle.

It is to be understood that bit body 12 can be formed of various shapes or designs depending, for example, on such factors as the type of formation, the type of cutting elements employed, and the mud program proposed. Bit body 12 may be formed of any suitable material, such as various types of steel, or infiltrated tungsten carbide.

Figure 4:
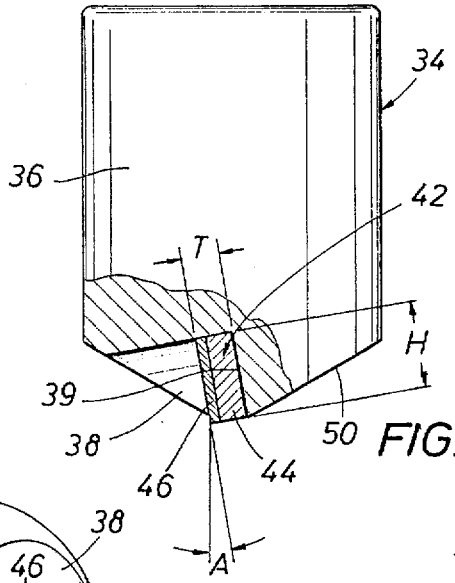
FIG. 4 is an elevational view of the center cutting element shown in FIG. 3 and showing in section a PDC cutter mounted on a supporting base surface of the stud.
Figure 5:
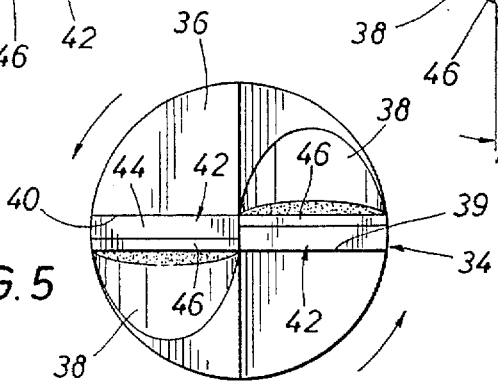
FIG. 5 is a bottom plan of a center cutting element of FIGS. 3 and 4 and showing the opposed semi-circular PDC cutters.

A cylindrical center cutting element is shown generally at 34 at the center of bit body 20 projecting downwardly from the crown or bottom 22 of bit body 20 along the longitudinal axis of bit body 20. Crown 22 has an integral central sleeve or protuberance 35 projecting downwardly therefrom along the rotation axis of bit 10. Center cutter element 34 forms an important part of this invention and includes a cylindrical stud or post 36 preferably formed of tungsten carbide and secured within an opening 37 defined by protuberance 35, such as an interference fit or brazing, for example. The projecting end of cylindrical stud 36 has a pair of pockets 38 milled or ground therein to form a pair of opposed supporting bases or surfaces 39 and 40 therein facing in opposite directions and disposed generally at 180 degrees to each other as shown particularly in FIGS. 2 and 5, for example. A polycrystalline diamond compact (PDC) cutter generally indicated at 42 is mounted on each base surface 39, 40 for example, by brazing. Each cutter 42 is of a semicircular shape and has a tungsten carbide base 44 and an outer thin diamond layer or cutting face 46 secured to base 44 by brazing. While cutting face 46 is preferably formed of polycrystalline (man-made) diamond material, it may be formed from other materials, such as for example, natural diamond or tungsten carbide. It is desirable that cutting faces 46 have a negative rake or be inclined as shown in FIG. 4 with respect to the rotation of drill bit 10. A negative rake angle A illustrated in FIG. 4 is preferably about ten (10) degrees. It is believed that a negative rake angle between about five (5) degrees to about twenty (20) degrees would function adequately for a polycrystalline diamond face or a natural diamond face. While cutting face 46 has been illustrated as being of a semicircular shape and formed of a single type of material, it is apparent that other shapes or composite materials may be employed effectively. For example, a circular PDC disc may be utilized as the cutter on the cutting element. In some instances, a generally rectangular disc could be utilized in a satisfactory manner. The lower surfaces of stud 36 shown at 50 adjacent cutters 42 are tapered at an angle of around thirty (30) degrees, for example. The thickness T of cutter 42 is about 0.125 inch and the height H of cutter 42 is about 0.250 inch.

A plurality of blades or holders are mounted on bit body 12 including relatively short blades 52 and a pair of opposed relatively long blades 54. Short blades 52 include bottom portion 56 secured to the bottom 22 of bit body 12 and a side portion 58 extending along the side of bit body 12 as shown in FIGS. 1 and 2. Long blade 54 includes a side portion 60 and a bottom portion 62. Bottom portion 62 extends across the entire bottom 22 to central protuberance 35 receiving center cutting element 34. Bottom portions 62 of blades 54 along with protuberance 35 and center cutting element 34 separate bottom 22 of bit body 12 into two separate areas divided by bottom blade portions 62 which project downwardly from bottom 22 to form a wall-like surface across the bottom face of the bit for directing the flow of drilling fluid laterally outwardly upon rotation of drill bit 10. A plurality of PDC cutting elements 68 each including a stud with a circular disc cutter thereon are mounted on blades 52 and 54. Only one fluid discharge nozzle 26 is provided for each separate area. Nozzles 26 are positioned adjacent center cutter 64 in opposed relation to each other. A large discharge port 28 is necessary to obtain adequate turbulence for the washing action against the blades and the cleaning action against the bottom of the hole. A diameter of about 18/32 inch for port 28 has been found to be satisfactory for the entire range of bits.

Figure 6:
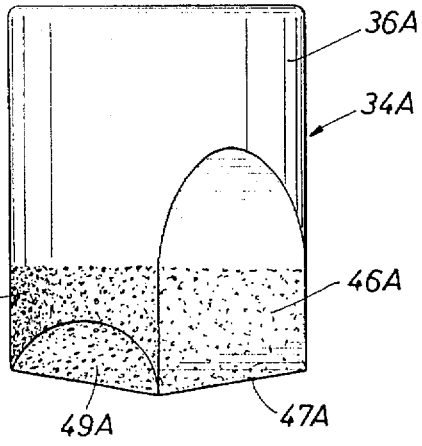
FIG. 6 is an elevational view of a modified center cutting element having cutters formed of natural diamond chips.
Figure 7:
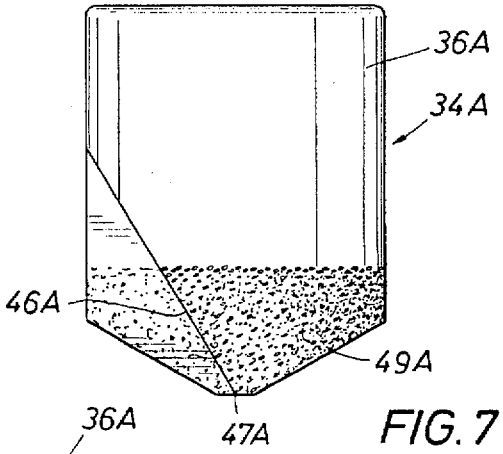
FIG. 7 is an elevational view of a modified cutting element shown in FIG. 6 taken at right angles from the position of FIG. 6.
Figure 8:
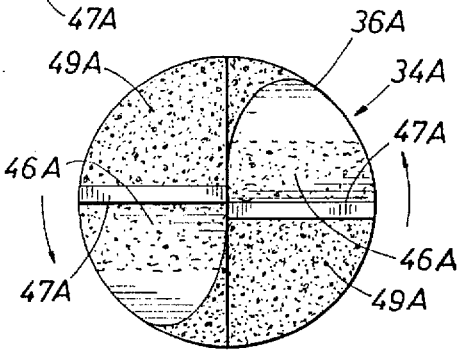
FIG. 8 is a bottom plan of the modified center cutting element shown in FIGS. 6 and 7.

Referring to FIGS. 6–8, a modified center cutting element is shown at 34A including a stud 36A formed of a tungsten carbide matrix. Stud 36A has a pair of opposed leading cutting faces 46A and a pair of opposed trailing faces 49A relative to the direction of rotation as shown by the arrows in FIG. 8. Cutting faces 46A have lower cutting edges 47A. Leading and trailing faces 46A, 49A are formed with natural diamond chips 44A flush set in the tungsten carbide matrix. About two (2) to six (6) natural diamond chips are provided for each carat. While faces 46A and 49A have been shown with diamond chips 44A extending to substantially the same height on stud 36A, it may be desirable to reduce the height on back faces 49A formed with diamond chips, or remove entirely the diamond chips on back faces 49A under certain conditions.

While preferred embodiments of the present invention have been illustrated in detail, it is apparent that modifications and adaptation of the preferred embodiments will occur to those skilled in the art. It is to be expressly understood that such modifications and adaptations are in the spirit and scope of the present invention as set forth in the following claims:

What is claimed is:

1. A drag drill bit for drilling a bore hole in an earth formation comprising:

a generally cylindrical bit body having a bottom and arranged for connection to a drill string to receive drilling fluid therefrom;

a cylindrical center cutting element mounted substantially on the axial center of said bit body and having a lower end projecting from the bottom and defining a pair of opposed cutting faces thereon;

a plurality of blades along the bottom of said bit body laterally outwardly of said cylindrical center cutter element; and a plurality of additional cutting elements mounted on said blades laterally outwardly from said cylindrical center cutting element.

2. A drag drill bit as set forth in claim 1 wherein:

said center cutting element comprises a cylindrical stud having a pair of pockets therein facing in opposite directions and forming supporting bases; and a cutter having a cutting face thereon is mounted on each of said supporting bases.

3. The drag drill bit as set forth in claim 2 wherein:

each cutting face comprises a semi-circular polycrystalline diamond compact.

4. The drag drill bit as set forth in claim 2 wherein:

each cutting face comprises a plurality of natural diamond chips.

5. The drag drill bit as set forth in claim 1 wherein:

a pair of opposed nozzles are positioned on said bit body adjacent said center cutting element.

6. The drag drill bit as set forth in claim 1 wherein:

said plurality of blades include a pair of opposed blades extending from opposite sides of said cylindrical center cutting element along the bottom and along the side of said bit body to separate the bottom of said drill bit into two opposed bottom areas.

7. The drill bit as set forth in claim 6 wherein:

a fluid discharge nozzle is mounted in each of said opposed areas adjacent said cylindrical center cutting element for the discharge of drilling fluid.

8. A rotary drill bit of the drag type for drilling a bore hole in an earth formation comprising:

a generally cylindrical bit body arranged for connection to a drill string for rotation and having a fluid passage therein to receive drilling fluid from the drill string;

a cylindrical center cutting element mounted on said bit body substantially at the axial center of said bit body and having a cutting face thereon for engaging the earth formation in cutting relation;

a pair of opposed blades on the bottom of said bit body extending from opposed sides of said cylindrical center cutting element along the bottom and side of said bit body to separate the bottom into two opposed areas; and a fluid discharge nozzle positioned in each of said opposed areas adjacent said cylindrical center cutting element in fluid communication with said fluid passage for the discharge of drilling fluid against said earth formation.

9. The rotary drill bit as set forth in claim 8 wherein:

said cylindrical center cutting element has a pair of cutting faces thereon facing in opposed directions.

10. The rotary drill bit as set forth in claim 8 wherein:

said cylindrical center cutting element comprises a cylindrical stud having a pair of pockets therein facing in opposite directions and forming supporting bases; and a cutter having a cutting face thereon is mounted on each of said supporting bases.

11. The rotary drill bit as set forth in claim 10 wherein:

a semi-circular polycrystalline diamond compact forms each of said cutting faces.

12. The rotary drill bit as set forth in claim 10 wherein a plurality of natural diamond chips form said cutting faces.

13. The rotary drill bit as set forth in claim 8 wherein a sleeve projects downwardly from the bottom of the bit body along the longitudinal axis of said bit body; and said cylindrical cutting element is secured within said sleeve.

14. The rotary drill bit as set forth in claim 13 wherein said opposed blades are secured to opposed sides of said sleeve.

15. The rotary drill bit as set forth in claim 13 wherein said cylindrical cutting element comprises a cylindrical stud having a projecting end portion and a pair of pockets formed on said projecting end portion and facing in opposite directions, and a cutter is mounted in each pocket.

* * * * *